United States Patent [19]

Diakun et al.

[11] Patent Number: 4,810,410

[45] Date of Patent: Mar. 7, 1989

[54] BLEACH ACTIVATION

[75] Inventors: Eileen M. Diakun; Christopher T. Wright, both of Warrington, England

[73] Assignee: Interox Chemicals Limited, London, England

[21] Appl. No.: 130,959

[22] Filed: Dec. 10, 1987

[30] Foreign Application Priority Data

Dec. 13, 1986 [GB] United Kingdom ..... 8629837

[51] Int. Cl.[4] ..... C11D 7/54; D06L 3/02; A62D 5/00

[52] U.S. Cl. ..... 252/102; 252/99; 252/186.33; 252/186.41; 252/186.43; 8/111

[58] Field of Search ..... 8/111; 252/186.38, 186.41, 252/186.43, 186.33, 186.44, 102, 99, 186.39

[56] References Cited

U.S. PATENT DOCUMENTS 3,156,654 11/1964 Konecny ..... 252/95
3,532,634 10/1970 Woods ..... 252/95

FOREIGN PATENT DOCUMENTS 0072166 2/1983 European Pat. Off. .
0954418 8/1982 U.S.S.R. .
0604990 7/1948 United Kingdom .
1120944 7/1968 United Kingdom .

*Primary Examiner*—Paul Lieberman
*Assistant Examiner*—John F. McNally
*Attorney, Agent, or Firm*—Larson and Taylor

[57] ABSTRACT

It is desired to enhance the ability of hydrogen peroxide and persalts at wash temperatures of around 30° to 70° C., in order to use less energy and to minimize damage to various fabric finishes. It has been proposed in the past to use transition metal compounds, including cobaltous compounds for this purpose, but the literature is self-conflicting in the way to do this. In repeat trials the simple cobaltous salts did not show much activation.

The invention provides a class of activators for persalts and hydrogen peroxide comprising cobalt III ammine complexes, preferably containing 4 or 5 ammine ligands obeying the formula:

$$Co[(NH_3)_nM_mB_bT_tQ_q]\ Y_y$$

Preferred complexes contain a chloride, bromide, hydroxyl or water ligand.

Such complexes can activate particularly well at above about pH10.2, which can vary from complex to complex, and retain activity in the presence of normal concentrations of many heavy duty washing compositions. At wash pHs below that pH, activity is exhibited in the presence of a promoter substance, namely an alkaline earth metal salt.

30 Claims, No Drawings

BLEACH ACTIVATION

The present invention relates to activation of bleaches employing hydrogen peroxide or materials that develop hydrogen peroxide, to compositions that activate hydrogen peroxide or such materials, to bleach compositions, including washing compositions containing a bleach, which contain an activator for hydrogen peroxide or such materials and to processes for bleaching and/or washing employing the aforesaid types of compositions. In particular, the present invention is directed to activation using transition metals, and especially to improvements in the use of cobalt compounds for activation.

It has been suggested in various patent specifications or other publications that the bleaching of stains or other materials effected by hydrogen peroxide or other materials that generate hydrogen peroxide in use, such as sodium perborate or other persalts or hydrogen peroxide adducts, can be enhanced employing additionally a cobalt compound. The earliest disclosure found in the course of the investigations leading to the present invention, GB patent specification No. 604,990, in the name of Lever Bros., however, related to a philosophically different concept, namely an increase in the in situ generation of oxygen bubbles to remove food particles and other stains from dentures. It will be well understood that the generation of oxygen gas from a peroxygen compound removes its activity, and hence its ability to act as bleach or oxidant to a very considerable extent.

In 1964, it was proposed by Koneeny et al in U.S. Pat. No. 3,156,654 to employ chelated cobaltous or cuprous ions to enhance decomposition of peroxides and thereby promote bleaching. The specification asserts that any improvement in bleaching obtained by adding a simple cobalt salt by itself is small and accorpanied by excessive peroxide loss. The disadvantage is allegedly overcome by adding a complexing agent for the transition metal ions such as pyridine-carboxylic acids and amino carboxylic acids. It will be recognised that these are classes of compounds that had previously been disclosed to be stabilisers for hydrogen peroxide so that the presence of such compounds would be expected to prolong the effective life of the peroxide, and hence prolong its interaction with any stain or substrate to be bleached. The patentee was able to show some bleach enhancement for the catalyst system compared with use of the persalt alone, but the disclosure was deficient in that no comparative results were given using the stabiliser plus persalt. Secondly, from the text, it would appear that the pH of the bleach solution was allowed to attain its natural pH, so that differences in bleaching may also be attributable, at least in part to changes in bleach pH rather than to the additives. Accordingly, there is reasonable justification for treating with caution the assertion in the specification that activation is caused by the interaction of cobaltous salts and amino chelating agents.

The picture is confused to some extent by later disclosures by Woods et al in U.S. Pat. No. 3,532,634. This specification states with especial reference to cobaltous compounds that there is a substantial distiction between various different members of the class of complexing agents identified by Koneeny et al as amino-carboxylic acids. Woods indicates that ethylene amino carboxylic acids are unsuitable whereas Koneeny had described them as suitable complexing agents for a cobalt activation system. Woods accordingly advocates the use of complexing agents based on aromatic heterocyclic compounds containing one or more nitrogen heteroatoms, including (di)picolinic acid and 1,10-phenanthroline when an organic activator is employed as well as the cobalt and complexing agent. In fact, Wood's results show that if the organic activator is not present, the resultant bleach enhancement is much smaller than if it is present, sometimes even to the point of being virtually undetectable. For example, 1,10-phenanthroline or 2,2'-bipyridine plus cobalt each gave an increase of about 1% only, which is insignificant compared with the best results of about 155 to 160%.

The picture for the researcher is further confused by other patent references. Thus, Example 1 in GB specification No. 1,120,944, invented by Das et al. demonstrated that when a cobaltous salt was included in a stain removing composition without a water-insoluble carrier, a worse reflectance was acheived than when the cobaltous salt was also omitted. On the other hand AU. UN. Sci. Res. in Russian patent specification No. 954,418 assert that 1,10-phenanthroline and a cobaltous salt catalyses peroxide bleaching.

In more recent times, the picture is confused even further by disclosure by Procter & Gamble in EP-A-00 72 166 that a catalyst composition for a peroxygen bleaching agent that contains a catalytic heavy metal cation, such as cobalt, preferably includes as sequestrant polyamino-polycarboxylate or polyamino- polyphosphonate compounds. It will be recalled that the polyamino- polycarboxylate compounds are the same ones that Woods said were "unsuitable" because they had complex formation constant of above log 10.

It is readily apparent that the present-day research worker contemplating the use of cobalt as a catalyst for hydrogen peroxide or persalts encounters contradictory assertions as to the possible effectiveness of the compounds. In addition to the foregoing inconsistencies, the disclosures also differed as to whether traditional detergent builders such as polyphosphates can be used with or without impairing bleach activation.

Investigations in order to identify bleach activation systems for hydrogen peroxide employing a cobalt compound confirmed that there was a considerable disparity in the ability of a range of cobalt species to act as activators. Thus, in some trials simple water-soluble cobaltous salts demonstrated virtually no activation. For example, a series of trials employing sodium perborate and a currently available base detergent composition obtained the same degree of stain removal (bleach performance) irrespective of whether the cobalt salt and/or complexing agent (dipicolinic acid) was present, under otherwise identical conditions. This is contrary to a simple interpretation of the disclosures in U.S. Pat. No. 3,156,654 discussed hereinabove, from which one would have expected there to be some detectable differences.

It is an object of the present invention to define a class of water-soluble cobalt compounds that are capable of activating hydrogen peroxide in alkaline conditions and it is a further object to identify conditions in which such compounds can be effective.

According to a first aspect of the present invention there is provided a low temperature bleaching process employing under alkaline conditions hydrogen peroxide or a material that develops hydrogen peroxide which is activated by a catalytic amount of a cobalt compound characterised in that the cobalt compound employed is selected from water-soluble cobalt III complexes having the formula:

$$Co[(NH_3)_nM_mB_bT_tQ_q]Y_y$$

in which n represents an integer from 1 to 6, M represents a monodentate ligand, m an integer from 0 to 5, B a bidentate ligand, b an integer from 0 to 2, T a tridentate ligand, t either 0 or 1, Q a tetradentate ligand, q being either 0 or 1, provided that $n+m+2d+3t+4q=6$ and Y represents a water-soluble counterion present in an appropriately selected number y to obtain a charge-balanced salt.

It will be recognised that it contrast with earlier attempts to employ cobalt as an activator, there is a very significant difference in the nature of the compounds. It will be observed that the cobalt compound is a particular selection of cobalt III complexes. Earlier attempts employed cobaltous compounds which have been shown by the instant inventors not to activate as well under identical conditions. It is particularly surprising that a cobalt III complex would demonstrate activation, since various cobalt III complexes have hitherto been alleged to suffer from kinetic inertness, eg in Advanced Inorganic Chemistry (Second Edition) by Cotton & Wilkinson, published by Interscience (John Wiley & Sons).

It will be recognised that the complexes employed in the present invention contain at least one ammonia ligand. It has been found that it is the presence or absence of such a ligand which indicates whether or not the cobalt III complexes tested are likely to show activation of hydrogen peroxide. Particularly encouraging results have been obtained when the cobalt III complexes contain mainly ammonia ligands, namely are tetra and more preferably penta ammonia complexes. The remaining ligand or ligands, M, B, T, and Q, as the case may be, can be selected from a wide range of ligands, provided that the cobalt coordination number of 6 is satisfied. A combination of ligands with different denticities can be used, and more than one different monodentate or bidentate ligands can be present in the same complex, the main difficulty being the practical one of how to make such complexes without undue effort.

Some of the proven monodentate ligands can be described as labile, viz of similar lability to, or more preferably greater lability than oxalate, $C_2O_4^{2-}$. Without being restricted to any particular theory, it is currently believed that in the bleaching medium, the monodentate ligand may be replaced by an hydroxyl or possibly a perhydroxyl ligand, and that the activity of the complex may correlate with the kinetics of the exchange, good activation occuring with a fast exchange, as seen from use of the preferred ligands, viz a labile halide, including especially a chloride or a bromide. Naturally, in the complex introduced, the monodentate ligand can be hydroxyl, as in cobalt pentaamine hydroxide or water. One of the most interesting complexes comprises cobalt pentaammine chloride. Other suitable monodentate ligands include nitrite ligands.

Other ligands which can suitably be incorporated in the complex include bidentate ligands such as ethylene diamine, tridentate ligands such as diethylene triamine and tetradentate ligands such as triethylene tetramine. However, the related complexes made from cobalt III and the same multi-dentate ligands but in the absence of ammonia ligand(s) are excluded from the selection, because they have not caused bleach activation consistently. It will seen, therefore, just how critical is the boundary between suitable and unsuitable complexes for the present purpose.

The counterion in the cobalt complex salt can be any inorganic or organic anion that leaves the salt sufficiently soluble in the bleaching medium. In practice, this represents no major constraint. Common inorganic anions such as halide, nitrate, sulphate or perchlorate can be used. Alternatively water-soluble organic anions such as formate, acetate or oxalate may be used too.

Many of the complexes usable herein have been prepared previously, often as laboratory curiousities without any particular practical function being in mind. Preparative routes for some are given in "Inorganic Syntheses" published periodically by McGraw-Hill, and many of the others by straightforward variation to the starting materials in those methods. Whilst many of the complexes may appear to have only relatively low solubilities, possibly of the order of a few grams per liter in water, they are employed in catalytic quantities in alkaline solution and thus such solubility levels are normally much higher than is required.

It has been discovered in the present investigations that the extent of activation shown by the invention complexes depends upon two further factors that hitherto has not been recognised properly. One of these factors is the pH of the washing/bleaching solution and the second is the nature of the alkalinity contributing to the pH of the solution.

We have found that there is a marked change in the extent of activation as the pH of the washing/bleaching solution is increased, called herein the change pH. It will be understood that the rate of change and the location of the change pH tends to vary from complex to complex, but that they share the feature of demonstrating markedly improved activation at above their own change pH. The location of the change pH can be found easily by conducting a short set of bleach trials at a series of maintained pHs increasing by 0.1 units in the presence of a heavy duty detergent composition. For cobaltic ammine complexes like cobalt pentammine chloride the change pH occurs in the region of about the range of about pH 10.1 to 10.4. It should be recognised, though, that this feature is superimposed upon the fact that the invention cobalt III complexes are comparatively active, even below the change pH. One inference that could be drawn is that there is some significant change in the activating species or the mechanism of activation that occurs on passage through the change pH. For the avoidance of doubt, the instant invention is not limited to any theory as to the reason for the change. The increased activity has two beneficial side-effects, which will become clearer in due course. In one side effect, the bleach/wash solution above the change pH can tolerate much higher concentrations of some other components of heavy duty detergent compositions, and in the second side effect the alkalinity need not include a source of alkaline earth metals to promote activity.

As referred to hereinabove, there is a second factor which is relevant to the extent of activation of hydrogen peroxide by the cobalt III complexes, and which had not been properly appreciated in past references to using cobalt. This factor is the influence of alkaline earth metals on activation. The presence of a modest concentration of any alkaline earth metal, including magnesium, calcium, and barium promotes the activation of the cobalt III complexes at any alkaline conditions. However, the promotion is particularly useful at solution pHs below the change pH for the complex in that in the absence of the alkaline earth metal salt activation is often not discernible at pH 10 or lower. At a pH above the change pH, the alkaline earth salt continues to enhance activation, and therefore its presence is always beneficial.

Some natural water supplies contain a significant concentration of alkaline earth metal salts in solution, such as those derived in chalky areas, other supplies such as those in granite or similar areas can be virtually free from dissolved alkaline earth metal salts. Furthermore, in hard water areas, an increasing number of users have installed water-softeners which operate by exchanging alkali metal ions for alkaline earth metal ions. Accordingly, there are many potential users of the present invention who could risk not benefitting from the cobalt III complex unless an appropriate amount of alkaline earth metal salt was provided additionally.

It is possible, but can be less convenient for the separate addition to a bleach or washing solution of the various components necessary for bleach activation according to the present invention to take place.

According to a second aspect of the invention, there is provided an activator composition suitable for addition to and activation of a hydrogen peroxide-containing bleach solution which comprises a mixture of at least 1 part by weight of an alkaline earth metal salt calculated as calcium carbonate per part by weight of the afore-mentioned selection of cobalt III complexes. In practice, the weight ratio of the alkaline earth metal salt (so calculated) to the cobalt complex is normally not more than 400:1 and is often in the range of 4:1 to 200:1, especially when the composition is intended for use at below the change pH described above. Such a composition is advantageously employable in soft-water areas but can also be used without disadvantage in naturally hard water areas. Such activator compositions are intended for use in conjunction with a separately added peroxide, which naturally can be either solid or liquid, and buffered to any alkaline pH, i.e. above or below the change pH. Most conveniently, such compositions will be particulate, such as a mixture of particles of both components, in order for them to be stored and transported or incorporated with other components to form ready to use formulations.

It will be understood that the invention also provides storable bleach additive compositions in which a peroxide in solid form is mixed with the aforementioned selection of cobalt III complexes, optionally also together with an alkaline earth metal salt. It will be recognised that in the absence of an alkaline earth metal salt, the compositions are eminently suited to use in hard water areas (without interposed softening) at any alkaline pH, or in solutions adjusted to or maintained above the change pH. In such solid peroxide/cobalt complex compositions, the weight ratio of the peroxide (calculated as the weight of hydrogen peroxide) to cobalt complex is normally in the range of 1:1 to 1200:1. Within that range, the ratio of peroxide to complex is often from 10:1 to 80:1 on the same basis. Of course, when all three components are present in suitable ratios, ie, with the alkaline earth metal salt present in the aforementioned ratio to the complex, the composition can be used with full confidence that bleach activation will occur under all pH wash conditions.

The alkaline earth metal salts that can be employed in conjunction with the cobalt complexes are often selected from the halides, particuarly chloride, bromide or iodide, from water-soluble organic salts such as acetate or proprionate, or nitrates or nitrites. Although the alkaline earth metals as a class can be used, it is often very convenient to select the calcium salts, in view of their availability and cost. The most preferred compounds are often calcium chloride and calcium nitrate. The salts can be used irrespective of their degree of hydration. Thus, they can be used in anhydrous or hydrated forms, but of course where the salts are stored in physical contact with solids persalts that are prone to humidity-induced decomposition, prudence dictates that it may be more sensible to choose anhydrous or kinetically stable hydrated compounds in preference to more hydrated ones. By way of example, calcium chloride can be presented as a mono, di or hexahydrate or anhydrous, and the nitrate as tetra hydrate or anhydrous.

Depending upon the manner of use and storage, the peroxide can be in the liquid or solid states. Where the compositions to be stored contain both the peroxide and the cobalt complex, as well as optionally the alkaline earth metal salt, it is necessary for the peroxide to be in solid form or otherwise separated from the complex. This is readily achieved by use of well-known persalts, which include alkali metal perborates and alkali metal percarbonates. More particularly, commonest examples include sodium perborate mono or tetrahydrate, potassium perborate monohydrate and sodium carbonate perhydrate. Such a list is not exhaustive, and the other solid compounds that can produce hydrogen peroxide in the bleaching medium can correspondingly be used. These include adducts of hydrogen peroxide with sodium sulphate/sodium or potassium chloride and urea peroxide. Others of especial noteworthyness include super-perborates as defined in U.S. Pat. No. 4,185,960 to Interox. The persalts can be produced by the processes hitherto employed or described for their production. Advantageously, they can continue to be stabilised against decomposition in storage by stabilisers of long standing such as silicates.

Where the peroxide and cobalt are introduced separately into the bleaching medium, the peroxide can comprise any of the aforementioned solid peroxides and hydrogen peroxide itself in liquid form. This is of practical value in industrial bleaching operations where the use of liquid peroxide is readily implemented.

The bleaching processes and compositions referred to hereinbefore can employ a range of other components in addition to those already specified. These extra components can include alkalies, diluent fillers/processing aids, wetting agents/detergents and minor detergent adjuncts. The alkalies can include alkali metal carbonates, bicarbonates and silicates which can enable the bleaching media to have a pH in the desired range, such as pH9 to 12.5. The sodium salts are the most widespread. The diluent, if employed, is typically an alkali metal sulphate such as sodium sulphate. In the absence of more than a very small proportion of wetting agent, such compositions are often referred to as bleach compositions or bleach additive compositions, depending upon whether they are intended to be used alone or in conjunction with a detergent-containing formulation.

In some preferred compositions the three principal components are present or used in the amounts respectively of: Cobalt complex 1 part by weight, alkaline earth metal salt 2 to 300 parts by weight as caccium carbonate and peroxide/persalt 5 to 200 parts by weight as hydrogen peroxide. When expressed in alternative fashion, the mole ratio of alkaline earth metal to cobalt is often in the range of 2:1 to 400:1 and the mole ratio of peroxide/persalt to cobalt is often in the range of 20:1 to 10000:1. When additional components are present, the aforementioned amounts and ratios can be retained. The total proportion of persalt plus cobalt plus alkaline earth metal salt in bleach (additive) compositions is normally at least 10% w/w, and in many instances is from 25 to 75% w/w. The balance is provided by alkali, and/or filler/diluent and possibly with detergent adjuncts as outlined below.

The compositions can also include one or more surfactants, normally selected from anionic, nonionic, zwitterionic or amphoteric surfactants, preferably in the form of particles that do not melt or cake under normal storage conditions. In practice, the selection is usually water-soluble. Many suitable surfactants and their properties are well known, appearing in publications like "Synthetic Detergents" by Davidsohn and Milvidsky, published by George Godwin Ltd. in London and John Wiley & Sons in New York.

Suitable anionic surfactants are often selected from alkali metal, and especially sodium salts. Potassium salts or ammonium salts are alternatives somewhat similar to sodium, and if desired part of the surfactant can be present as the calcium salt, thereby acting not only as surfactant, but also as cobalt promoter. The range of anionic surfactants that can be employed beneficially depends to a considerable extent on the pH at which it is intended to use the bleach activation system. At a pH above the change pH for the complex, it is suitable to use any anionic surfactant, including both calcium sensitive and calcium insensitive surfactants. At a pH below the change pH for the complex, it is preferable to employ calcium insensitive surfactants, because their use will tend to augment rather than interfere with cobalt-based bleach activation, but naturally, a non-interfering concentration of calcium-sensitive surfactants may be tolerated.

The classes of calcium-insensitive anionic surfactants include olefin sulphonates, especially of $C_{10}$ to $C_{24}$ olefins, alkane and/or hydroxyalkane sulphonates, again often $C_{10}$ to $C_{24}$, alkyl phenoxy ether sulphates, often with a $C_8$ to $C_{12}$ linear alkyl carbon atoms and 1 to 10 ethylene oxide units, alkyl ether sulphates, often with a $C_{10}$ to $C_{20}$ alkyl chain and 1 to 10, preferably 2 to 4 ethylene oxide groups. Various other usable anionic surfactants include sulphocarboxylates, alkyl glyceryl ether sulphonates, monoglyceride sulphates and sulphonates and phosphated ethylene oxide-based nonionic surfactants.

The classes of calcium sensitive surfactants, i.e. those intended for use at pH 10.5 upwards, include linear alkyl benzene sulphonates, particularly those having a $C_9$ to $C_{15}$ alkyl group, conveniently a linear dodecyl group, and alkyl sulphates, especially those containing a $C_{10}$ to $C_{22}$ alkyl group. Carboxylic acid soaps, preferably $C_{12}$ to $C_{20}$ are also in this category.

Suitable nonionic surfactants for incorporation herein in many instances are condensation products of ethylene oxide and/or propylene oxide, typically from 5 to 30 units, with a hydrophobic moiety deriveved from an aliphatic alcohol, an alkyl phenol, an aliphatic acid, an aliphatic amine or an aliphatic amide. The hydrophobic moiety normally contains 8 to 22 linear carbon atoms in aliphatic compounds and an alkyl substituent group of 6 to 12 linear carbon atoms in the alkyl phenols. Alternatively or in addition to the condensed ethylene oxide units, suitable nonioncc surfactants can also comprise the condensation products of aliphatic polyols, such as particularly glycerol and sorbitol.

It is often convenient to include both anionic and nonionic surfactants in the process and compositions for washing according to the present invention, the weight ratio usually falling in the ratio 1:10 to 10:1.

Zwitterionic surfactants for use herein can be selected from water-soluble derivatives of aliphatic quaternary ammonium, phosphonium and sulphonium compounds which contain linear or branched alkyl moieties of which one substituent is $C_8$ to $C_{20}$, and one substituent that terminates in an anionic water-solubilising group particularly a sulphonate group. Examples include alkylhydroxy-propane sulphonates and alkyldimethyl-ammoniohydroxypropane sulphonates.

It is also possible to employ semipolar surfactants, including solid amine oxides, organic phosphine oxides and organic sulphur oxides, each containing a Chd 10 to oxides $C_{22}$ alkyl chain and often one or two $C_1$ to $C_3$ alkyl chains.

In addition tc the foregoing components of washing compositions, it is possible also to include one or more detergent adjuncts, which term normally includes soil anti-redeposition agents, dye transfer inhibitors, optical brightening agents, peroxide stabilisers, corrosion inhibitors, bactericides, foam modifiers, thickeners, dyes perfumes and enzymes in the manners in which they may included in persalt-containing washing compositions. The total adjuncts proportion is usually less than 20% of the washing composition and often from 3 to 10%, by weight.

Typically, the soil antiredepositon agents like carboxymethlycellulose and polyvinyl pyrrolidone are present in amounts of 0.5 to 2% of the composition, and up to 1% of optical brightening agents such as derivatives of diaminostilbene sulphonic acid, diarylpyrazolines and aminocoumarins. Peroxide stabilisers include very low levels of aminocarboxylic acids/salts, organic phosphonic acids/salts, hydroxyquinolines, and mono and dipicolinic acid, and they can to at least some extent function as dye transferinhibitors. 1 to 2% silicate can serve to inhibit corrosion and alkanolamides and ethylene oxide/propylene oxide copolymers are useful as foam regulators. The commercially available proteolytic enzymes may also be included, preferably being coated or otherwise protected by known soluble or dispersible materials to minimise interaction during storage with the other components.

It will be recognised that the cobalt catalyst system can be incorporated within particulate washing compositions containing the above-identified components or be employed in conjunction with separately added washing compositions in which case both liquid or solid compositions are useable.

In addition to the foregoing components, and particularly in heavy duty compositions, it is desirable to include one or more detergent builders. As with surfactants, the range of useable buiders depends upon whether the composition is intended for use at above or below the change pH for the complex. For uses both above and below the change pH, it is possible to employ certain alkalies that also exhibit some builder properties, and in particular alkali metal silicates and carbonates. However, for use at above the change pH, it is both practical and convenient to employ one or more of the commonly used detergent builders. Such builders include tripolyphosphates and tetrapyrophosphates, hydroxycarboxylate organic builders such as citrate and zeolitic builders like zeolite A. It is preferable to avoid concentrations in excess of about 0.7 g/l of strongly chelating organic builders, including typically,aminocarboxylic acid builders such as nitrilo triacetic acid salts and aminopolyphosphonic acid salts because of interference with bleach activation. However, these latter complexing builders are suitable at above the change pH at lower levels for other, eg stabilisation or corrosion-inhibition purposes.

Bleaching processes according to the present invention are especially well suited to low washing temperature conditions, particularly at 30° to 70° C. Wash temperatures above and below that range can be employed but improvement in bleach performance over use of a persalt alone is less likely to occur. Wash temperatures in the preferred range can be obtained either by heating up a cold solution or by introduction of warm water. It will be recognised therefore that the bleach or washing compositions can be used in a variety of methods. In the first way, the bleach compositions can be used as a pre-wash or in a warm rinse stage, respectively before of after the main wash stage, thereby dealing with readily oxidisable stains and builder/detergent-sensitive stains in separate stages. Alternatively, but in accordance with earlier-mentioned constraints, the fully formulated bleach/washing compositions can be used in a main wash stage or bleach additive compositions added to catalyst-free detergent compositions.

It is convenient to employ washing/bleaching solutions that have a pH maintained in the range of 8 to 12.5. For the reasons outlined herein, it is advantageous to maintain a pH above the change pH of the complex, and particularly from pH 10.5 to 12, for bleach activation in or with a heavy duty washing composition. For a pre- or post-wash bleach, however, it can also be convenient to employ a pH of from 8.5 to 10.5, carried out in the presence of an alkali metal salt, and most conveniently calcium, but in the substantial absence of the classes of calcium-sensitive surfactants and builders identified before herein.

The washing/bleaching liquors are normally maintained in contact with the article or surface from which stains are to be removed for a period of at least 5 minutes. In many processes contact is maintained for longer periods, typically 10 to 30 minutes to improve soil removal. Yet longer periods of an hour or longer may be employed at the discretion of the user.

It is desirable to employ a very dilute concentation of the cobalt complex in the bleaching/washing medium, in order to obtain the best benefit from the system. It is normally convenient to select the concentration of the complex within the range of concentrations of from 2 to 50 micromoles of cobalt per liter, and in many instances within the band of from about 4 to 40 micromoles per liter. The selection will normally take into account the other conditions and in particular whether the solution is above the change pH and contains also a heavy duty detergent composition, because such conditions enable the complex to be present at the higher end of the range, above about 12 micromoles without leading to its subsequent deposition on the washing. Secondly, the selection will tend to take into account the inherent capability of the complex to activate. In practice, this means that the system can be tailored to adjust to wide variations in the amounts of bleach added by the user without subtantially affecting the performance from the bleach system.

It is preferable to employ a substantially higher concentration of alkaline earth metal than of the cobalt complex, and normally at least 50 micromoles per liter. In many desirable processes, the concentration is selected within the range of 200 to 4000 micromoles per liter, and very good results can often be achieved at 400 to 1500 micromoles per liter. It is understood that to at least some extent such concentrations may be present in some water supplies, but that it advantageous to introduce such extra amounts in domestic applications, so as to guarantee that the cobalt can activate the bleach at below the change pH of the complex. For industrial users, it may be more convenient to monitor their water supply and rectify any deficiency by appropriate additions.

The concentration of bleach in the washing/bleaching solution is normally at least 1 millimole per liter, advantageously at least 2 millimoles per liter, and in many instances is preferably from 5 to 50 millimoles per liter, particularly for domestic usage. In industrial usages, depending of course upon the actual application, higher concentrations up to, for example, 100–200 millimoles of bleach can be contemplated.

The washing compositions containing the bleach or used in conjunction with the bleach can be employed over a very wide range of concentrations, depending in part upon the inclination of the user and the type of apparatus used. Even for use in domestic washing machines, the preferred concentrations can range from 0.5 to 50 g/l, depending mainly upon whether a long or short liquor ratio to the washing is provided by the machine. In practice, this means that the proportion of cobalt activator included in compositions for the long liquor American-style machines tends to be higher, typically by a factor of 5–10 than in compositions intended for short liquor European-style machines.

The instant invention compositions are eminently suitable for the bleach/washing domestically or in industrial laudries of soiled household washing of clothing and other fabrics, but it will be further and explicitly recognised that the activation of peroxide is especially apparent at a wash pH of pH11 or higher. This enables the system to be applied to dishwasher compositions that are buffered to such relatively high pH conditions often by their content of phosphates and silicates, which have been shown herein to be compatible with the activation system. Likewise, the compositions can be employed in the cleansing of hard surfaces, as for examples metals, plastics, glass or ceramics, including the cleansing of floors, work-surfaces and especially sanitaryware, the last-mentioned comprising baths, basins, bidets, sinks and toilets, and the attendant waste outlet pipeworks, many of which can also benefit from the use of comparatively highly alkaline coditions for cleansing and disinfection.

Having described the present invention in general terms, some specific embodiments will now be described more fully by way of example only.

In many of the Examples and comparisons, the following trial procedure described below and referred to as "standard procedure" was employed. In this procedure, swatches of a red-wine stained cotton cloth were washed for 20 minutes in an aqueous alkaline bleach solution in demineralised water that was buffered to a specified pH, often 10, 11 or 12, with aqueous sodium hydroxide and maintained at 40° C. The solution contained hydrogen peroxide or a persalt bleach that developed hydrogen peroxide often as the perhydroxyl anion in situ, and a soil anti-redeposition agent carboxymethyl cellulose. Where indicated, the bleach solutions also contained a simple cobalt salt or complexed cobalt III at a concentration of 2 mg/l unless otherwise indicated, which corresponds approximately to 7 to 8 micromoles of cobalt per liter and/or hydrated calcium nitrate, 212 mg/l providing 2.12 millimoles of calcium per liter. In certain instances, tap water was used instead and this contained approximately half the level of hardness, but in a mole ratio 3:1 calcium:magnesium.

The washing trials were carried out in a laboratory-scale washing machine available from the US Testing Corporation under their Trademark *Tergotometer* which is registered in some countries. After washing, each swatch was rinsed in cold water and air dried. The reflectance of the swatch was measured before and after washing, readings $R_S$ and $R_w$ respectively and compared with the reflectance of the cloth before staining, $R_c$ and the extent of stain removal in the washing process was calculated using the formula:

$$\% \text{ stain removal } (\%SR) = 100 \times (R_w - R_c)/(R_s - R_c)$$

A reflectance spectrophotometer from Instrumental Colour Systems under their Trademark *Micromatch*, Registered in some countries was used to make the measurements. The results given in the Tables are an average of two determinations, except where they are stated to be an average of four determinations.

Since several different batches of swatches were used in the course of the trials, the comparative effect on stain removal of the various bleach systems must be judged by reference to the respective comparison trial on the same batch.

EXAMPLE 1 AND COMPARSIONS A TO G

In this Example and these comparisons, the standard procedure was followed at pH10.

In comparisons C and D, the complex had the formula $[Co(trien)Cl_2]Cl$ and in E and F the formula $[Co(tren)Cl_2]Cl$ and in comparison G and Example 1 the formula was $[Co(NH_3)_5Cl]Cl_2$. The results are summarised in Table 1.

In all the following Tables an * indicates that the item is present. Trien represents triethlyenetetramine and tren triethylamine.

TABLE 1

| Ex/Comp No | Bleach System $H_2O_2$ | Cobalt Complex | Calcium Salt | % SR |
|---|---|---|---|---|
| CA | * | | | 46 |
| CB | * | | * | 38 |
| CC | * | * | | 42 |
| CD | * | * | * | 43 |
| CE | * | * | | 43 |
| CF | * | * | * | |
| 38 | | | | |
| CG | * | * | | 42 |
| 1 | * | * | * | 63 |

From Table 1, it can be seen clearly that the only cobalt III complex to activate bleaching was that used in Example 1, namely $[Co(NH_3)_5Cl]Cl_2$, by comparing the stain removal measured in Example 1 with the much lowere values obtained in all the other trials CA to CG. These results demonstrate that the ammonia-containing complexes perform differently from the similar multidentate amine complexes. The results also show that at this pH, which was below the change pH for the complex, activation occurred when the calcium salt was present, and not when it was absent. The other cobalt complexes tended to impair bleaching to a small extent.

COMPARISONS CH TO CK

In these comparisons, trials CA and CB were repeated, using the standard procedure, but using a different batch of stains and and containing in CJ and CK an hydrated cobaltous nitrate at a concentration of 2mg/l. The results are summarised in Table 2 below.

TABLE 2

| Ex/Comp No | Bleach System $H_2O_2$ | Cobalt salt | Calcium salt | % SR |
|---|---|---|---|---|
| CH | * | | | 44 |
| CI | * | | * | 48 |
| CJ | * | * | | 45 |
| CK | * | * | * | 49 |

From Table 2, it can be seen that the cobaltous salt showed virtually no enhanced bleach activity either in the absence or presence of a calcium salt, thereby confirming the prior art that soluble cobalt salts did not act as bleach promoters. At this pH, some activation from the calcium was observable, 4 units, seen by subtracting the value for CH from that for CI and that for CJ from that for CK.

EXAMPLES 2, 3 AND 4 AND COMPARISONS CL TO CT

In these Examples and comparisons, the Comparison CB was repeated, using the standard procedure, but using a different batch of red-wine stained swatches. In addition, the specified alkalies/builder compounds and/or the cobalt III complex of Example 1 was also employed. The washing solution contained calcium salt in addition to the peroxygen compound, which as before was aqueous hydrogen peroxide (35% w/w) at a concentration of 1g/l in all the Examples and comparisons in this set. NTA represents nitrilotriacetate. The results are summarised in Table 3 below.

TABLE 3

| Ex/Comp No | Bleach System Alkali/Builder Type | Amount | Cobalt Complex | % SR |
|---|---|---|---|---|
| CL | | | | 38 |
| 2 | | | * | 59 |
| CM | $Na_2CO_3$ | 0.75 g | | 39 |
| 3 | * | * | * | 55 |
| CN | Na Citrate | 0.75 g | | 47 |
| CO | * | * | * | 47 |
| CP | Na NTA | 0.75 g | | 52 |
| CQ | * | * | * | 51 |
| CR | Na silicate | 0.50 g | | 45 |
| 4 | * | * | * | 60 |
| CS | Zeolite A | 0.50 g | | 40 |
| CT | * | * | * | 42 |

From Table 3, it can be seen that at pH 10, ie below the change pH, sodium carbonate and sodium silicates enabled the cobalt complex to activate the peroxide bleaching, but the addition of builder amounts of sodium citrate, NTA or zeolite all removed activation.

EXAMPLES 5 AND 6 AND COMPARISONS CU AND CV

In these Examples and comparisons, Example 1 and comparison CB respectively were repeated, using the standard procedure, but employing respectively sodium percarbonate (PCS) and sodium perborate (PBS) to provide the same amount of available oxygen as the aqueous hydrogen peroxide had done. The results are summarised in Table 4 below.

TABLE 4

| Ex/Comp No | Bleach System: Persalt | Cobalt salt | Calcium salt | % SR |
|---|---|---|---|---|
| CU | PCS | | * | 40 |
| 5 | * | * | * | 53 |
| CV | PBS | | * | 40 |
| 6 | * | * | * | 52 |

From Table 4, it can be clearly seen that PSB and PCS both are activated by the cobalt complex/calcium salt in the same way as hydrogen peroxide is.

EXAMPLES 7 AND 8 AND COMPARISONS CW AND CX

In these Examples and comparisons, Example 1 and comparison CB respectively were repeated, using the standard procedure, except that in addition surfactants were present, respectively a nonionic surfactant available under the Trade Mark *Synperonic 3S70* in a concentration of 1g/l or an anionic surfactant available under the Trade Mark *Synperonic A7* in a concentration of 1g/l, Synperonic being registered in some countries. The results are summarised in Table 5.

TABLE 5

| Ex/Comp No | Bleach System: Cobalt salt | Calcium salt | Surfactant | % SR |
|---|---|---|---|---|
| CW | | * | 3S70 | 41 |
| 7 | * | * | * | 56 |
| CX | | * | A7 | 42 |
| 8 | * | * | * | 58 |

From Table 5, it can be seen that activation with the cobalt complex and calcium is retained in the presence of the surfactants.

EXAMPLE 9 AND COMPARISON CY

In this Example and comparison, Example 6 and comparison CV respectively were repeated, using the standard procedure, except that the alkaline earth metal promoter was magnesium nitrate, introduced at a concentration of 100 mg/l (of the hexahydrate) into the bleach liquor. No calcium was present. The results are given in Table 6.

TABLE 6

| Ex/Comp No | Bleach System: Persalt | Cobalt salt | Magnesium salt | % SR |
|---|---|---|---|---|
| CY | PBS | | * | 59 |
| 9 | * | * | * | 63 |

From Table 6, it can be seen that the magnesium salt enabled some bleach activation to be achieved.

EXAMPLES 10 TO 13 AND COMPARISONS CZ TO CAC

In these Examples and comparisons, the standard procedure was followed employing as cobalt complex where indicated, $[Co(NH_3)_5Cl]Cl_2$, and bleach solution pHs of respectfully pH11 and pH12, with a new set of red-wine stained swatches. The results are summarised in Table 7 below.

TABLE 7

| Ex/Comp No | Bleach System: $H_2O_2$ | Cobalt Complex | pH Calcium Salt | % SR | |
|---|---|---|---|---|---|
| CZ | * | | | 11 | 43 |
| CAA | * | | * | 11 | 60 |
| 10 | * | * | | 11 | 62 |
| 11 | * | * | * | 11 | 74 |
| CAB | * | | | 12 | 50 |
| CAC | * | | * | 12 | 63 |
| 12 | * | * | | 12 | 68 |
| 13 | * | * | * | 12 | 75 |

From Table 7, it can be seen that the cobalt complex is able to activate the bleach both in the absence of as well as in the presence of calcium. Indeed, there is a cumulative activation from both the cobalt and the calcium. Secondly, it can be seen that in the absence of calcium, it is particularly beneficial to employ the higher pH of pH12, whereas in the presence of calcium, a very similar result is achieved at both pHs.

EXAMPLES 14 AND 15 AND COMPARISONS CAD AND CAE

In these Examples and comparisons, the standard procedure was modified by employing different washing machines and a range of stains on two cloth types. The pH of the solution was allowed to attain its natural pH without subsequent adjustment, but the alkali was added to produce pH11. The Co complex was $[Co(NH_3)_5Cl]Cl_2$. The main wash cycle was used in the Philips machine, CAD and Ex. 14, without a bulk load, but the liquor contained 11.2 g PBS, 1.5 g $Ca(NO_3)_2.4H_2O$ and 14 g NaOH. In CAE and Ex. 15, the machine used was a Maytag, in a regular wash cycle. The bleach liquor contained 75.2 g PBS, 10.1 g $Ca(NO_3)_2.4H_2O$, and 94 g NaOH. The results are shown in Table 8 below. ATT is an alkaline-treated tea stain.

TABLE 8

| Ex/Comp | CAD | 14 | CAE | 15 |
|---|---|---|---|---|
| Machine | Philips | | Maytag | |
| PBS | * | * | * | * |
| Co Complex | | * | | * |
| Cloth/Stain | % SR | % SR | % SR | % SR |
| Cotton | | | | |
| Red Wine | 49 | 63 | 37 | 61 |
| Blackberry | 75 | 80 | 71 | 78 |
| Tea | 34 | 39 | 34 | 40 |
| ATT | 31 | 44 | 27 | 42 |
| Polycotton | | | | |
| Red Wine | 45 | 57 | 41 | 60 |
| Blackberry | 85 | 88 | 78 | 88 |
| Tea | 32 | 42 | 31 | 45 |

From Table 8, it can be seen that the enhanced stain removal is obtained with the invention complex for a range of stains and using other washing machines

EXAMPLE 16, 17 AND COMPARISONS CAF, CAG

In these Examples and comparisons, the standard procedure at pH11 was followed, using $[Co(NH_3)_5Cl]Cl_2$, but the bleach liquoar contained additionally a heavy duty base detergent composition (BD1) at 8 g/l having the following approximate composition:

| Component | % w/w |
|---|---|
| Anionics | 11 |
| nonionics | 4 |
| Sodium Tripolyphosphate | 30 |
| Sodium Sulphate | 27 |
| Sodium Silicates | 6 |
| Sodium Carbonate | 12 |
| Water/minors | 7 |

In CAG and Ex. 17 tap water was used. The results are summarised in Table 9.

TABLE 9

| Ex/Comp No | Bleach System Persalt (PBS) | Cobalt complex | Calcium salt | % SR |
|---|---|---|---|---|
| CAF | * | | * | 51 |
| 16 | * | * | * | 61 |
| CAG | * | | * | 50 |
| 17 | * | * | * | 61 |

From Table 9, it can be seen that the cobalt complex was still able to activate the persalt bleach composition, even in the presence of a substantial concentration of a standard builder, sodium tripolyphosphate that is included at least partly for its ability to take metals ions out of solution.

When similar tests were performed using cobaltous chloride instead of the cobalt III complex, on a different sample of stains there was no gain in stain removal by addition of the cobalt salt, and if anything, there was a slight impairment in stain removal. All the results in that series were about 59 to 61% stain removal, whether or not the cobalt salt was present.

EXAMPLES 18 TO 21 AND COMPARISONS CAI TO CAL

In these Examples and comparisons, the procedure of Example 17 and CAG was repeated, but using the base detergents DB2 to DB5 at the same concentration, 8 g/l on other samples of stains, always together with PBS at 1.6 g/l. The approximate compositions in % w/w of the formulations were:

| Component | DB2 | DB3 | DB4 | DB5 |
|---|---|---|---|---|
| Anionics | 10 | 18 | 6 | 1 |
| Nonionics | 4 | 3 | 3 | 16 |
| Soaps | | 2 | | |
| Sodium Tripolyphosphate | 27 | | 33 | 62 |
| Zeolite "A" | | 23 | | |
| Sodium Sulphate | 40 | 28 | 35 | 2 |
| Sodium Silicates | 7 | 1 | 5 | 13 |
| Sodium Carbonate | 1 | 6 | 1 | 1 |
| Water/minors | 7 | 1 | 11 | 4 |

The results are summarised in Table 10.

TABLE 10

| Ex/Comp No | Bleach System Persalt (PBS) | Cobalt complex | Detergent base | % SR |
|---|---|---|---|---|
| CAI | * | | DB2 | 50 |
| 18 | * | * | * | 60 |
| CAJ | * | | DB3 | 44 |
| 19 | * | * | * | 49 |
| CAK | * | | DB4 | 51 |
| 20 | * | * | * | 58 |
| CAL | * | | DB5 | 50 |
| 21 | * | * | * | 60 |

From Table 10, it can be seen that the activation shown in Table 9 is repeated in the presence of a range of different detergent compositions.

EXAMPLES 22, 23 AND 24 AND COMPARISONS CAM TO CAV

In these Examples and Comparison CAM, the standard procedure was followed at pH11 in tap water containing PBS (1.6 g/l ) and detergent base DB2 (6.4 g/l), and the cobalt complex indicated. The trials were repeated so that each figure given is an average of four assessments.

TABLE 11

| Ex/Comp | Cobalt Complex | % SR |
|---|---|---|
| CAM | | 49.6 |
| 22 | $[Co(NH_3)_6]Cl_3$ | 51.2 |
| 23 | $[Co(NH_3)_5C_2O_4]ClO_4$ | 53.3 |
| 24 | $[Co(NH_3)_5CO_3]Cl$ | 50.8 |

From Table 11, it can be seen that some activation of the persalt had occurred consistently. The effect can be amplified by the use of higher concentrations of the complex.

In a further series of trials carried out with a further stain and indentical conditions to these three Examples, but with two assessments only, it was found that none of the following related cobalt III complexes activated the persalt at all, although all four contain nitrogen atoms that coordinate with the cobalt. En represents ethylenediamine; trien and tren as in comparisons C and E.

TABLE 12

| Ex/Comp | Cobalt Complex | % SR |
|---|---|---|
| CAN | | 52 |
| CAO | $[Co(en)_3]Cl_3$, | 50 |
| CAP | $[Co(trien)Cl_2]Cl$ | 51 |
| CAQ | cis$[Co(tren)Cl_2]Cl$ | 51 |
| CAR | trans $[Co(en)_2Cl_2]Cl$ | 51 |

Table 12 shows that the stain removal of all four systems was worse than using solely detergent plus PBS.

In a yet further set of trials under the same conditions as CAN to CAR, various simple cobalt salts were tried. Once again a different sample of stain was used. The results are shown in Table 13.

TABLE 13

| Ex/Comp | Cobalt Salt | % SR |
|---|---|---|
| CAS | | 50 |
| CAT | Cobalt Nitrate, 2.5 mg/l | 49 |
| CAU | Cobalt Chloride, 2 mg/l | 50 |
| CAV | Cobalt Acetate, 2.1 mg/l | 50 |

From Table 13, it can be seen that in the presence of detergent the simple cobalt salts did not cause bleach activation of the PBS.

EXAMPLES 25 TO 27 AND COMPARISON CAW

In this Examples and comparison, the effect of changing the concentration of persalt and cobalt complex is demonstrated. All the washings were carried out using the standard procedure at pH11 in tap water in the presence of detergent base DB2 at 8.0 g/l concentration. The complex used was $[Co(NH_3)_5Cl]Cl_2$. Table 14 shows the %SR measured.

TABLE 14

| Ex/Comp | CAW | 25 | 26 | 27 |
|---|---|---|---|---|
| | % SR at | | | |
| Cobalt complex (mg/l) (g/l) | 0 | 2 | 5 | 10 |
| 0.4 | 46 | 43 | 45 | 46 |
| 0.8 | 48 | 49 | 52 | 53 |
| 1.2 | 50 | 54 | 56 | 59 |
| 1.6 | 52 | 58 | 61 | 63 |
| 2.0 | 52 | 58 | 63 | 66 |
| 2.4 | 52 | 61 | 64 | 66 |

From Table 14, it can clearly be seen that the extent of activation increases markedly with both increase in complex concentration and PBS concentration in the ranges tested, in the presence of the detergent which kept the complex from depositing upon the cloth being washed.

EXAMPLES 28, 29 AND COMPARISON CAX

In these Examples and comparison the standard procedure was followed using tap water, maintained at pH11 with NaOH, and a single batch of red-wine stained cotton swatches. All the washes employed PBS at 1.6 g/l and detergent base DB2 at 6.4 g/l. The Examples both employed as cobalt complex $[Co(NH_3)_5Cl]Cl_2$, at concentrations of respectfully 5 mg/l and 10 mg/l. The washes were carried out at the temperature shown in Table 15 rather than the standard temperature.

TABLE 15

| Ex/Comp | CAX | 28 | 29 |
|---|---|---|---|
| Cobalt complex (mg/l) | 0 | 5 | 10 |
| Temp °C. | % SR measured | | |
| 30 | 46 | 48 | 49 |
| 40 | 52 | 58 | 62 |
| 50 | 58 | 68 | 70 |
| 60 | 69 | 76 | 77 |
| 70 | 76 | 77 | 78 |

From Table 15, it can be seen that the complex activates particularly well in the range of 40° to 60° C., but that activation also is observable in the rest of the range of 30° to 70° C.

EXAMPLE 30 AND COMPARISON CAY

This Examples demonstrates how to find the change pH for a complex. The washes were carried out under standard conditions using tap water containing PBS at 1.6 g/l and Detergent base DB2 at 6.4 g/l, at the pH specified in Table 16, which was maintained with addition as necessary of NaOH solution. The complex used was $[Co(NH_3)_5Cl]Cl_2$ in the Example at a concentration of 5 mg/l. The swatches were red-wine on cotton. The comparision used no cobalt compound at all.

TABLE 16

| Ex/Comp | CAY | 30 |
|---|---|---|
| pH | % SR measured | |
| 9.5 | 74 | 74 |
| 10.0 | 73 | 73 |
| 10.1 | 72 | 73 |
| 10.2 | 72 | 74 |
| 10.3 | 72 | 77 |
| 10.5 | 73 | 81 |
| 10.8 | 71 | 83 |
| 11.0 | 70 | 85 |
| 11.5 | 67 | 86 |

From Table 16, it can be seen that the change pH for the complex under these was conditions occurred at about pH 10.2 to 10.3. Below that pH the detergent base acts to mask out the activation that the complex would cause, but increasingly at a pH above 10.3, activation becomes much more noticeable. It will be observed that the stain removal tends towards a plateau level at above pH 11, whereas the stain removal was diminishing at the higher pHs in the absence of the complex. The results confirm that ph 10.5 to 11.5 represents an excellent range of alkalinities to employ.

EXAMPLES 31 TO 41 AND COMPARISONS CAZ TO CBD

In these Examples and comparisons, trials were made to see whether the complex continued to activate a persalt in the presence of various detergent composition components at the concentrations given in Table 17. The washes were carried out under the standard procedure in tap water, containing PBS at 1.6 g/l and maintained at pH 11. The complex used was $[Co(NH_3)_5Cl]Cl_2$. In Table 17, the Example result must be compared with the preceding comparison. DTPMP represents diethylene triamine penta(methylene phosphonate) available under the Trademark DEQUEST 2060, EDTMP ethylene diamine tetra(methylene phosphonate) under the Trademark DEQUEST 2041, (DEQUEST is registered in some countries) NTA nitrilotriacetate and EDTA ethylene diamine tetraactate.

TABLE 17

| Ex/Comp | Detergent Component (g/l) | % SR |
|---|---|---|
| CAZ | | 58 |
| 31 | Trisodium Citrate (2 g/l) | 71 |
| CBA | | 56 |
| 32 | Sodium Zeolite A (2 g/l) | 70 |
| CBB | | 59 |
| 33 | Sodium Stearate (0.5 g/l) | 68 |
| CBC | | 58 |
| 34 | Sodium Tripolyphosphate (2 g/l) | 67 |
| 35 | Sodium Orthophosphate (2 g/l) | 71 |
| 36 | Sodium Pyrophosphate (2 g/l) | 66 |
| CBD | | 57 |
| 37 | DTPMP (0.2 g/l - 50% actives) | 63 |
| 38 | EDTMP (0.114 g/l - 88% actives) | 69 |
| 39 | EDTA di-Sodium (0.1 g/l) | 62 |
| 40 | EDTA di-Sodium (0.5 g/l) | 62 |
| CBD | | 57 |
| 41 | NTA tri-Sodium (1 g/l) | 61 |

From Table 17 it can be seen that the combalt III complex retained at least some activation in the presence of typical concentrations of both inorganic and organic builders such as the phsophates, zeolite and citrate, and also in the presence of even moderate concentrations of organic complexing agents such as the amino-carboxylates and amino-phosphonates.

EXAMPLES 42, 43 AND COMPARISONS CBE, CBF

In these Examples and comparisions, the standard procedure was followed using tap water containing PBS at 1.6 g/l, detergent base DB2 at 6.4 g/l and maintained at either pH 10.5 or 11. The complex employed was $[Co(NH_3)_5H_2O]Br_3$.

TABLE 18

| Ex/comp | pH | Cobalt Complex | % SR |
|---|---|---|---|
| CBE | 10.5 | | 72 |
| 42 | * | * | 75 |
| CBF | 11 | | 71 |
| 43 | * | * | 77 |

From Table 18 it can be seen that the complex caused activation of the PBS.

We claim:

1. In a low temperature washing or bleaching process employing in an aqueous solution under alkaline conditions hydrogen peroxide or a material that develops hydrogen peroxide which is activated by a catalytic amount of a cobalt compound the improvement in which the cobalt compound employed is selected from water-soluble cobalt III complexes having the formula:

$$Co[(NH_3)_nM_mB_bT_tQ_q]Y_y$$

in which n represents an integer from 1 to 6, M represents a monodentate ligand, m an integer from 0 to 5, B a bidentate ligand, b an integer from 0 to 2, T a tridentate ligand, t either 0 or 1, Q a tetradentate ligand, q being either 0 or 1, provided that $n+m+2d+3t+4q=6$ and Y represents a water-soluble counterion present in an appropriately selected number y to obtain a charge-balanced salt, said solution further comprising an alkaline earth metal salt in an amount of 1 to 400 parts by weight per part by weight of said cobalt complex.

2. A process according to claim 1 characterised in that the bleach/wash solution has a pH in the range of pH8 to pH12.5.

3. A process according to claim 1 characterised in that the cobalt complex is present at a concentration selected in the range of from 2 to 50 micromoles per liter.

4. A process according to claim 3 characterised in that the cobalt complex is present at a concentration of 4 to 12 micromoles per liter at a pH below the change pH of the complex.

5. A process according to claim 1 characterised in that the bleach/wash solution has a concentration of at least 50 micromoles per liter of an alkaline earth metal salt when it has a pH below the change pH of the cobalt complex.

6. A process according to claim 1 characterised in that the alkaline earth metal salt is present in a concentration of up to 4000 micromoles per liter.

7. A process according to claim 6 characterised in that the solution contains an alkaline earth metal salt selected from calcium salts, and preferably chloride, bromide, nitrate, perchlorate or acetate.

8. A process according to claim 1 characterised in that the cobalt complex is selected from complexes in which the monodentate ligand M is chloride, bromide, hydroxyl or water.

9. A process according to claim 1 characterised in that n in the formula for the complex represents 4, 5, or 6.

10. A process according to claim 9 characterised in that in the formula for the complex n is 5 and M is chloride.

11. A process according to claim 1 charcterised in that the solution contains at least 2 millimoles per liter of hydrogen peroxide, introduced as such or developed in situ.

12. A process according to claim 11 characterised in that the solution contains from 5 to 50 millimoles per liter of hydrogen peroxide.

13. A process according to claim 1 characterised in that the solution has a temperature of from 30° to 70° C.

14. A process according to claim 1 characterised in that the solution has a pH above the change pH of the complex and contains one or more calcium-sensitive surfactants.

15. A process according to claim 14 characterised in that the surfactant is an alkyl benzene sulphonate.

16. A process according to claim 14 characterised in that the solution contains one or more detergent builders selected from alkali metal polyphosphates, orthophosphates and pyrophosphates or zeolites or hydroxycarboxlate complexing builders.

17. A process according to claim 1 characterised in that the solution contains one or more soil anti-redeposition agents.

18. A process according to claim 1 characterised in that the solution contains one or more alkali metal carbonates or silicates and/or calcium-insensitive surfactants.

19. A process according to claim 18 characterised in that the calcium-insensitive surfactant is selected from non-ionic surfactants and sulphated or phosphated derivatives.

20. An activator composition suitable for addition to and activation of a hydrogen peroxide containing bleach solution which comprises a mixture of a least 1 part by weight of an alkaline earth metal salt calculated as calcium carbonate per part by weight of the cobalt III complexes having the formula:

$$Co[(NH_3)_nM_mB_bT_tQ_q]Y_y$$

in which n represents an integer from 1 to 6, M represents a monodentate ligand, m an integer from 0 to 5, B a bidentate ligand, b an integer from 0 to 2, Ta tridentate ligand, t either 0 or 1, Q a tetradentate ligand, q being either 0 or 1, provided that $n+m+2d+3t+4q=6$ and Y represents a water soluble counterion present in an appropriately selected number y to obtain a charge-balanced salt characterized in that the weight ratio of the calculated weight of the alkaline earth metal salt calculated to the cobalt complex is not more than 400:1.

21. A composition according to claim 20 characterised in that the weight ratio of the calculated weight of the alkaline earth metal salt calculated to the cobalt complex weight is in the range of 4:1 to 200:1.

22. A storable bleach additive composition containing a peroxide in solid form mixed with a metal activator characterised in that the metal activator is a cobalt III complex as described in claim 1, and optionally also containing an alkaline earth metal salt.

23. A composition according to claim 22 characterised in that it contains the peroxide (calculated as the weight of hydrogen peroxide) to cobalt complex in a weight ratio in the range of 1:1 to 1200:1.

24. A composition according to claim 23 characterised in that it contains the peroxide (calculated as the weight of hydrogen peroxide) to cobalt complex in a weight ratio in the range of 10:1 to 80:1.

25. A composition according claim 22 characterised in that it contains an alkaline earth metal salt in a weight ratio to the cobalt complex in the range of 4:1 to 200:1.

26. A composition according to claim 22 characterised in that it also contains one or more surfactants and/or one or more detergent builders.

27. A composition according to claim 26 characterised in that the surfactant and builder are calcium-insensitive, thereby enabling the composition to be employed at a pH below the change pH of the complex.

28. A composition according to claim 26 characterised in that the builder is selected from alkali metal polyphosphates, pyrophosphates and orthophosphates, alkalimetal silicates, alkali metal carbonates, sodium zeolites, and alkali metal citrates, for use at a solution pH above the change pH of the complex.

29. A composition according to claim 22 characterised in that the peroxide in solid form represents 5 to 40% by weight of the composition.

30. A process for washing/bleaching comprising the steps of forming an aqueous dispersion or paste of a washing composition and bringing the dispersion or paste into contact with a hard surface, dishes or other material to be cleansed characterised by employing as the washing composition a composition according to any of claims 22 to 29.

* * * * *